US007497734B2

(12) United States Patent
Josephson

(10) Patent No.: US 7,497,734 B2
(45) Date of Patent: Mar. 3, 2009

(54) REDUCED CROSSTALK DIFFERENTIAL BOWTIE CONNECTOR

(75) Inventor: Andrew D. Josephson, Plymouth, MN (US)

(73) Assignee: General Dynamics Advanced Information Systems, Inc., Fairfax, VA (US)

( * ) Notice: Subject to any disclaimer, the term of this patent is extended or adjusted under 35 U.S.C. 154(b) by 0 days.

(21) Appl. No.: 11/509,731

(22) Filed: Aug. 25, 2006

(65) Prior Publication Data

US 2008/0050969 A1 Feb. 28, 2008

(51) Int. Cl.
*H01R 13/648* (2006.01)

(52) U.S. Cl. ..... 439/608; 439/941

(58) Field of Classification Search ..... 439/608, 439/108, 941

See application file for complete search history.

(56) References Cited

U.S. PATENT DOCUMENTS

| | | | | |
|---|---|---|---|---|
| 2,124,207 | A | 7/1938 | Carl | |
| 6,527,587 | B1 * | 3/2003 | Ortega et al. | 439/608 |
| 7,044,794 | B2 * | 5/2006 | Consoli et al. | 439/608 |
| 7,114,964 | B2 * | 10/2006 | Winings et al. | 439/79 |
| 2005/0170700 | A1 | 8/2005 | Shuey et al. | |

* cited by examiner

*Primary Examiner*—Javaid Nasri
(74) *Attorney, Agent, or Firm*—Steptoe & Johnson LLP

(57) ABSTRACT

A connector is provided. A plurality of parallel pins is mounted in a connector. A circuit board is connected to the connector. Some of the pins are configured to communicate signals from the circuit board and others of the pins are configured to communicate corresponding signal grounds from the circuit board. The pins are organized on the connector such that at least two out of every three of the pins that are configured to communicate signals do not have any neighboring aggressor pins.

25 Claims, 6 Drawing Sheets

Flex 1 Location

Flex 1 Location

REDUCED CROSSTALK DIFFERENTIAL BOWTIE CONNECTOR

BACKGROUND OF THE INVENTION

1. Field of the Invention

The present invention relates to an electrical connector. More specifically, the present invention relates to a symmetrical electrical connector that can connect with identical copies in which the individual signal lines have minimized crosstalk.

2. Discussion of Background Information

The use of circuit boards is well known in the data processing industry. Multiple circuit boards housed in larger towers need to be connected together to allow the signals to pass from one to the other. One such connector is called a "bowtie connector," in which both ends of the connector are identical and can connect together orthogonally. Specifically, the male and female pins are separated into four separate quadrants. The signals and grounds are then assigned to specific pin pathways along the wires in the connectors. The pins are organized around an axis of symmetry so that one set of male/female pins is two quadrants that are the mirror image of the opposing set of female/male pins in the opposing two quadrants. Thus, two identical connectors will carry the proper signal if one connector is rotated 90° relative to the other connector.

FIG. 1 shows an example of a signal pin layout on such a bowtie connector 100. The pin layout is separated into four quadrants: top 102, bottom 104, left 106 and right 108 in FIG. 1, in which the top and bottom 102 and 104 include male connectors ("M") and the left and right 106 and 108 include female connectors ("F"). The diagonal line 110 from the top left to the bottom right defines the axis of symmetry. Thus, if two connectors of the same type are rotated 90°, then the proper male and female connectors will always align and connect.

Male connectors are typically referred to as "pins," whereas female connectors are referred to as "sockets." For ease of discussions, the term "pins" herein shall cover both.

The electrical pathways that connect the circuit boards to the pins are typically provided via flexible printed circuit boards, which support pathways on both sides of the flexible printed circuit board. An example of such a flexible printed circuit board 200 is shown in FIG. 2. In general, a single flexible printed circuit board can connect with two columns of pins on the end connector (often referred to as a "header"). In the prior art of FIG. 1, the male and female connectors collectively form fourteen (14) columns, such that seven (7) flexible printed circuit boards can provide connections for all of the pins in the design of FIG. 1. FIG. 3 illustrates which pins align with the various flexible printed circuit boards.

In the prior art design, the assignment of signals and grounds to various pins was driven by mechanical concerns. For example, it was determined that it was conceptually simple to track the signals along the flexible printed circuit boards if the various signal pairs were aligned one after each other on opposite sides of the flexible printed circuit board. As a result, the signal carrying pins are aligned along diagonals parallel with an axis of symmetry.

SUMMARY

According to an embodiment of the invention, a connector is provided. A plurality of parallel pins is mounted in a connector. A circuit board is connected to the connector. Some of the pins are configured to communicate signals from the circuit board and others of the pins are configured to communicate corresponding signal grounds from the circuit board. The pins are organized on the connector such that at least two out of every three of the pins that are configured to communicate signals do not have any neighboring aggressor pins.

The above embodiment may have various features. The pins may be organized on the connector such that only one pair of the pins that is configured to communicate a common signal has at least two neighboring aggressor pins. The connector may be separated into two quadrants in which the pins are male and two different quadrants in which the pins are female. The connector may be a bowtie connector. At least one flexible printed circuit board may be connected to the pins. The flexible printed circuit board may have conductive pathways on two sides thereof. The signals may comprise distinct signal pairs, where pathways for individual signal pairs of approximately half of the signals are on common sides of the flexible printed circuit board, and pathways for individual signal pairs of a remainder of the signals are on opposite sides of the flexible printed circuit board.

According to another embodiment of the invention, a connector is provided. A plurality of parallel pins is mounted in a connector. A circuit board is connected to the connector. Some of the pins are configured to communicate signals from the circuit board and others of the pins are configured to communicate corresponding signal grounds from the circuit board. The pins are organized on the connector such that any diagonally adjacent pins aligned in a straight line through their axis will include at least one of the pins configured to communicate corresponding signal grounds and at least one of the pins configured to communicate signals.

The above embodiment may have various optional features. The pins may be organized on the connector such that only one pair of the pins that is configured to communicate a common signal has at least two neighboring aggressor pins. The connector may be separated into two quadrants in which the pins are male and two different quadrants in which the pins are female. The connector may be a bowtie connector. At least one flexible printed circuit board may be connected to the pins. The flexible printed circuit board may have conductive pathways on two sides thereof. The signals may comprise distinct signal pairs, pathways for individual signal pairs of approximately half of the signals that are on common sides of the flexible printed circuit board, and pathways for individual signal pairs of a remainder of the signals are on opposite sides of the flexible printed circuit board.

According to yet another embodiment of the invention, a connector is provided. A plurality of pins is configured to carry thirty-six distinct signal pairs and thirty-six corresponding signal ground pairs. Twenty-four of the thirty-six distinct signal pairs have no neighboring aggressor pins. Eight of the thirty-six distinct signal pairs have a single neighboring aggressor pin. Four of the thirty-six distinct signal pairs have two neighboring aggressor pins.

The above embodiment may have various features. The connector may be separated into two quadrants in which the pins are male and two different quadrants in which the pins are female. The connector may be a bowtie connector. At least one flexible printed circuit board may be connected to the pins. The flexible printed circuit board may have conductive pathways on two sides thereof.

According to a still yet another embodiment of the invention, a connector is provided. A plurality of parallel pins is mounted in a connector. A circuit board is connected to the connector. Some of the pins are configured to communicate signals from the circuit board and others of the pins are configured to communicate corresponding signal grounds from the circuit board. The pins are organized such that any four adjacent pins aligned in a straight line through their axis that includes at least one of the pins configured to communicate signals will also include at least one of the pins configured to communicate corresponding signal grounds.

The above embodiment may have various features. The pins may be organized on the connector such that only one pair of the pins that is configured to communicate a common signal has at least two neighboring aggressor pins. The connector may be separated into two quadrants in which the pins are male and two different quadrants in which the pins are female. The connector may be a bowtie connector. At least one flexible printed circuit board may be connected to the pins. The flexible printed circuit board may have conductive pathways on two sides thereof. The signals may comprise distinct signal pairs, where pathways for individual signal pairs of approximately half of the signals are on common sides of the flexible printed circuit board, and pathways for individual signal pairs of a remainder of the signals are on opposite sides of the flexible printed circuit board.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of certain embodiments of the present invention, in which like numerals represent like elements throughout the several views of the drawings, and wherein.

DETAILED DESCRIPTION OF EXEMPLARY EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

A drawback of the prior art designs of bowtie connectors is the presence of crosstalk, in which signals from different signals lines bleed into adjacent signal lines as undesirable noise. Crosstalk is a frequency-dependent variable and has thus become a more prevalent concern as technology improves and signals run at higher and higher frequencies.

The effects of crosstalk on any particular signal pathway is dependent upon the number of "neighboring aggressor" pins, i.e., pins adjacent to the signal pair that carry signals from different signal pairs. For example, in FIG. 3 pin pair 07N/P has five adjacent signal paths from different signal pairs: 02N, 03N, 06N, 08P AND 09P; pin pair 07N/P therefore experiences the collective crosstalk effects from five neighboring signals. In other examples, pin pair 18N/P has two adjacent aggressor pins (17P and 16P), and pin pair 12N/P has five adjacent aggressor pins (15N, 16N, 13P, 11N, 12N).

Figure 1:
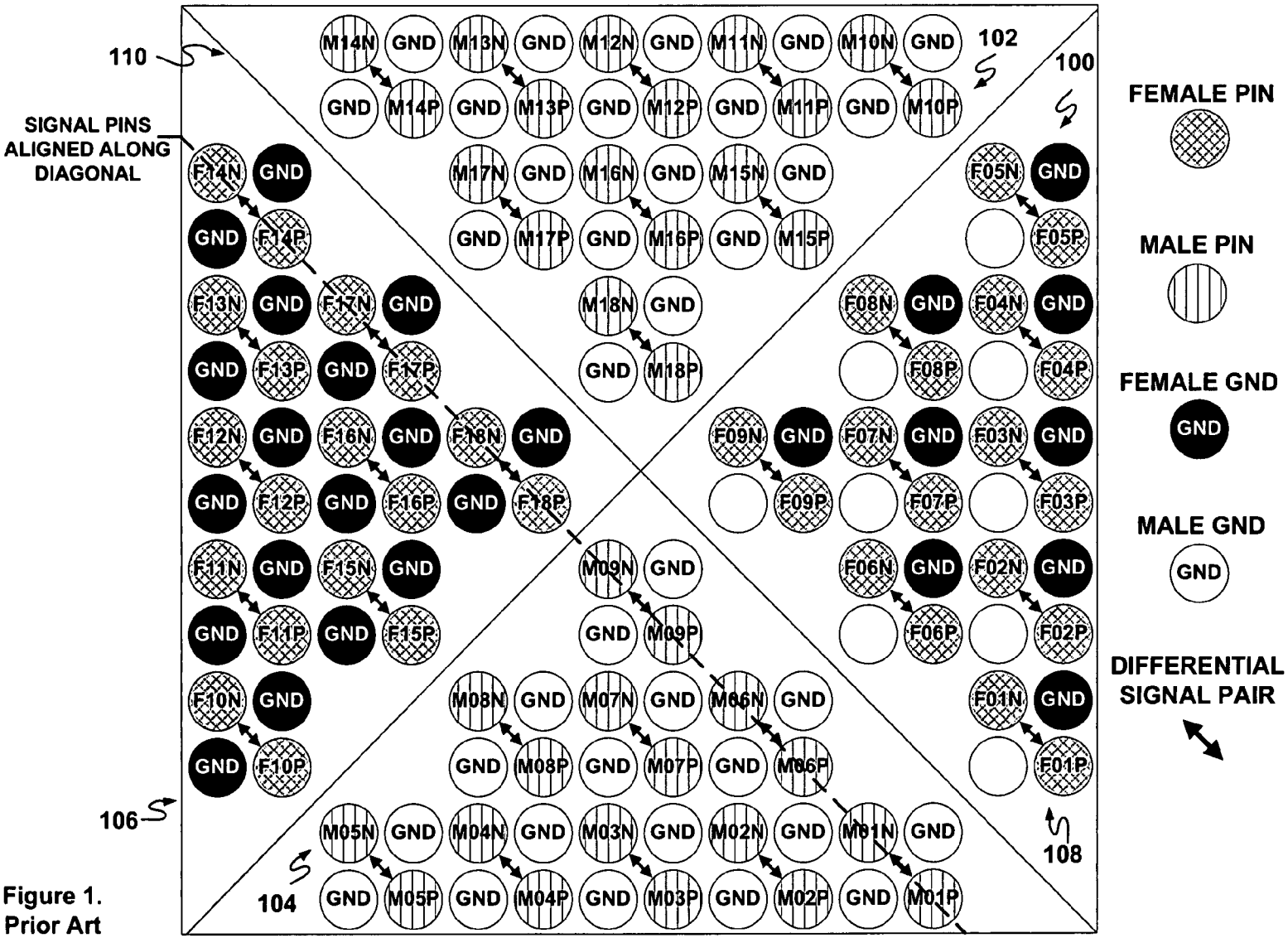
Figure 1. Prior Art
FIG. 1 illustrates the signal pin arrangement of a prior art bowtie connector.
Figure 4:
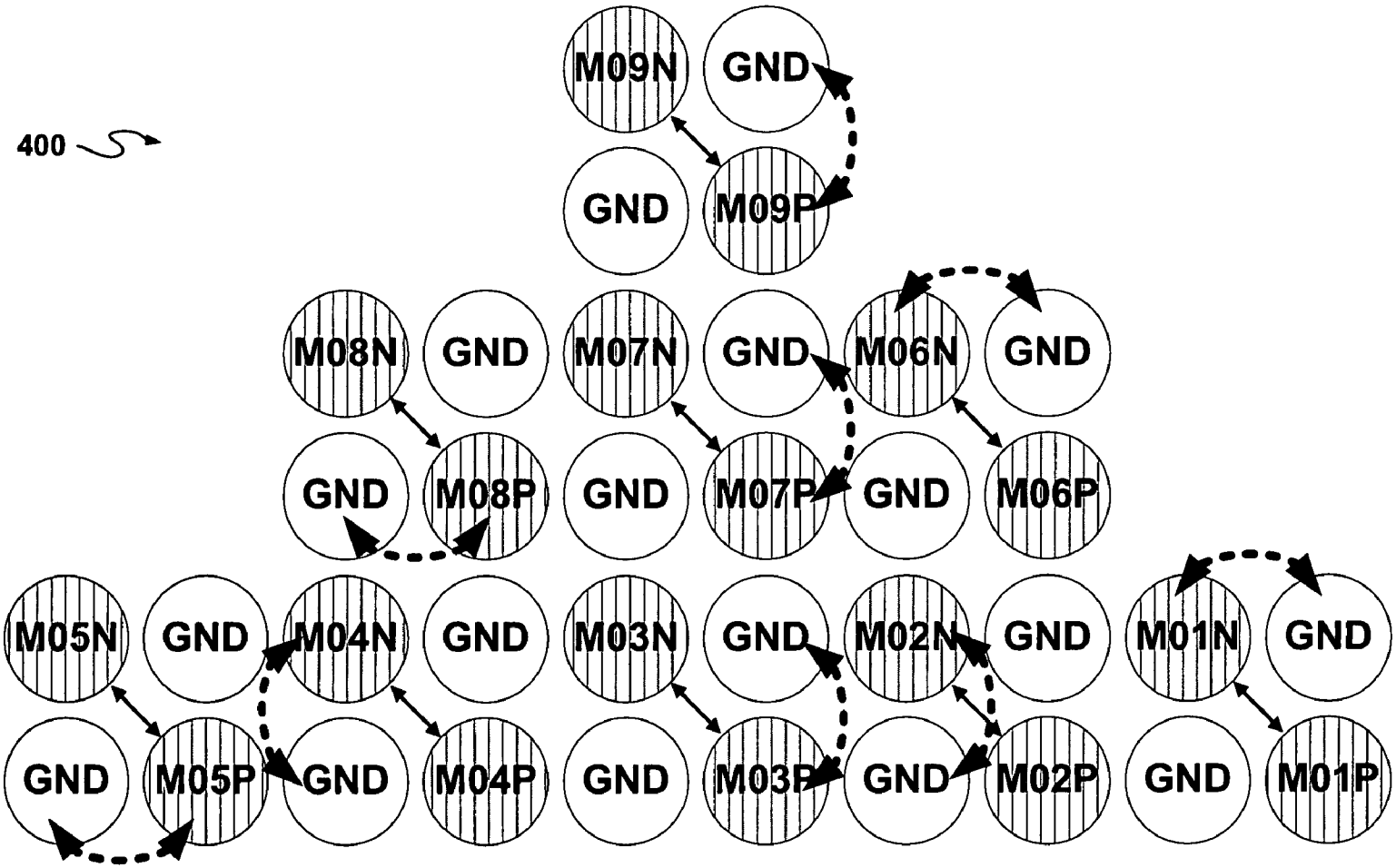
FIG. 4 illustrates the rearrangements of signal pin paths according to an embodiment of the invention.

Referring now to FIG. 4, the individual connector pins from bottom quadrant 104 of FIG. 1 is rearranged according to a method of the present invention to define a new signal path configuration 400. When possible, one of the two signal pins in each signal pair is reassigned to flow over the path of an adjacent ground pin. This reassignment results in the signal carrying pin "moving" toward the outer periphery of the quadrant, and the ground pin toward the center of the quadrant. ("Moving" herein refers to a change in which signals travel over which pins, not a physical change in actual pins.) In the embodiment of FIG. 4, pins for eight (8) of the nine (9) signals were moved in this fashion. The exception is signal 3P, which was moved inward away from the outer periphery of the quadrant to avoid conflict with 2N (moved) and 4P (original position).

Figure 5:
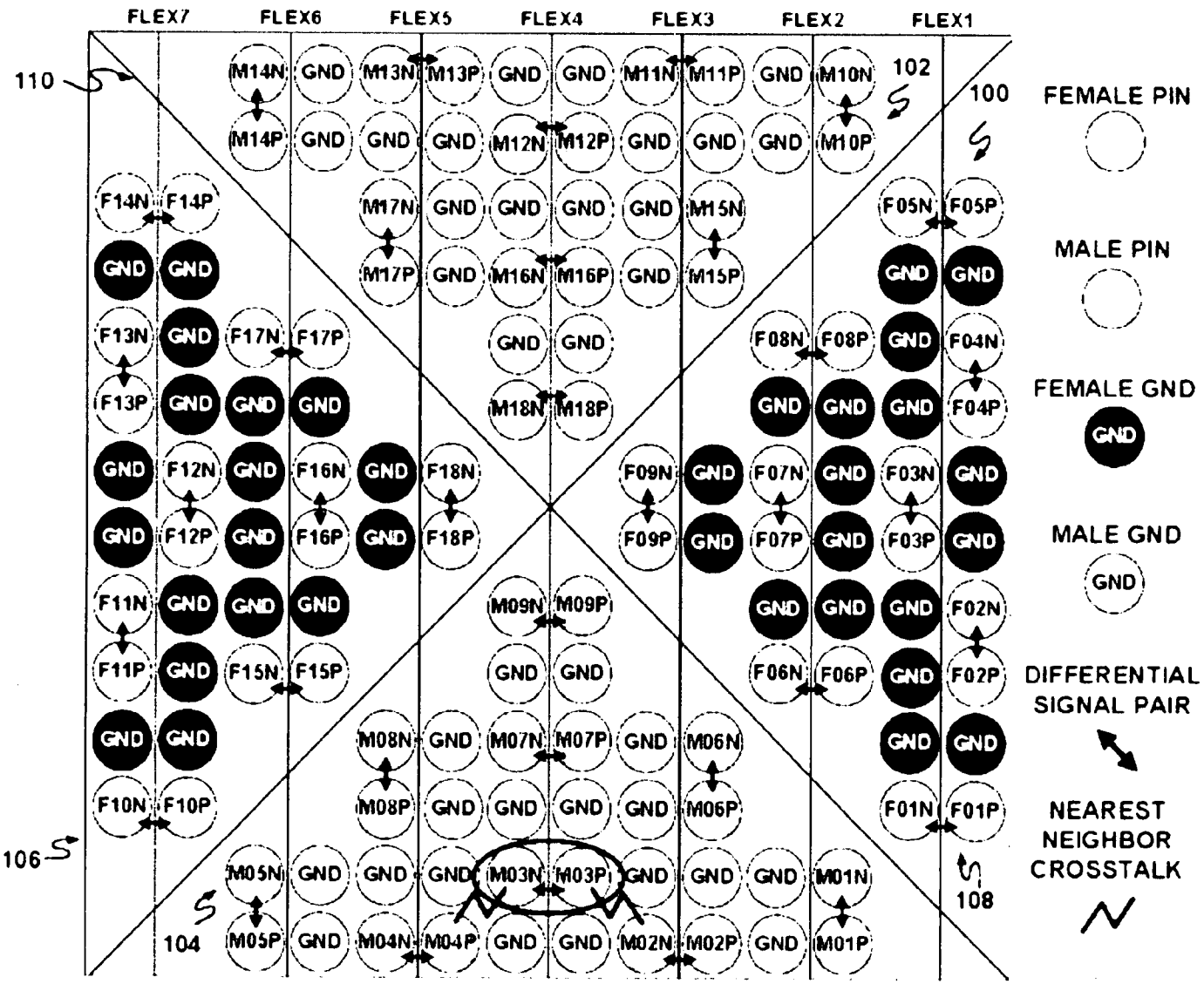
FIG. 5 illustrates a signal pin configuration for a bowtie connector according to an embodiment of the present invention.

Referring now to FIG. 5, the same changes made to bottom quadrant 104 in FIG. 4 are made for the corresponding (female) left quadrant 106, and symmetrical changes are made on quadrants 102 and 108 on the other side of the axis of symmetry 110. These collective changes preserve the "bowtie" nature of the connector.

Figure 3:
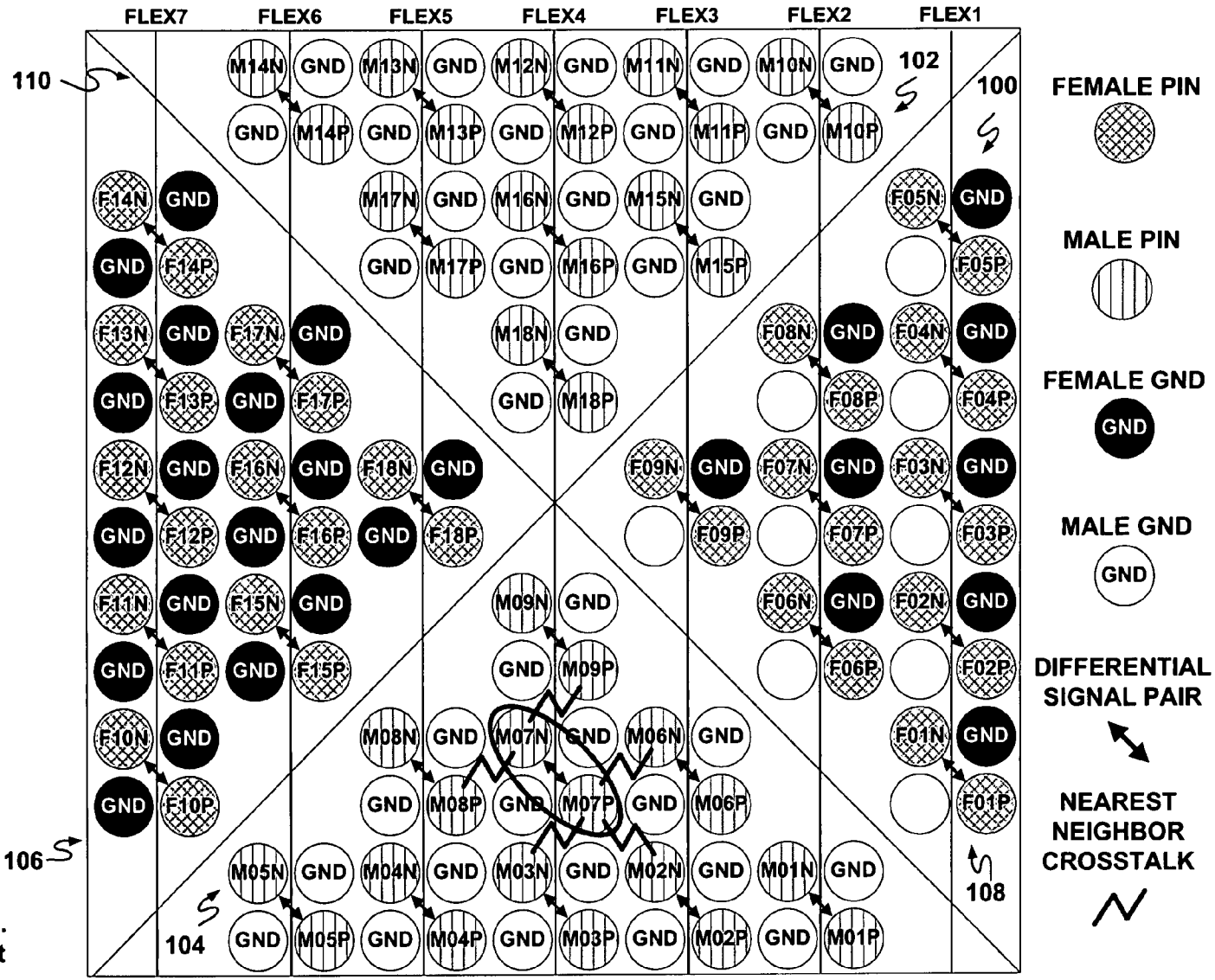
Figure 3. Prior Art
FIG. 3 illustrates a dispersement of flexible printed circuit boards within the signal pin arrangement of the bowtie connector of FIG. 1.

The orientation of signal pins in FIG. 5 results in considerably less neighboring aggressor pins than FIGS. 1 and 3. For example, in the design of FIG. 1 the signal pair 07 N/P had cross-talk from five neighboring aggressor pins. In the embodiment of FIG. 5, the signal pair 07 N/P has no (zero) adjacent aggressor pins at all, as each of the signal carrying pins is separated from any other signal carrying pin pair by at least one ground pin or an empty space. Preferably at least two out of every three signal pairs has no (zero) adjacent aggressor pins. Thus, of the thirty six (36) signal pin pairs in FIG. 5, twenty four (24) do not have any (zero) neighboring aggressor pins, eight (8) have a single (one) neighboring aggressor pin, and four (4) have 2 (two) neighboring aggressor pins.

Since crosstalk is inversely and exponentially related to the distance between the pins ($1/d^2$), the resulting repositioning of the signal pathways reduces the crosstalk on the majority of signal pins. For example, signal lines 14P and 17N are twice as far apart in FIG. 5 compared to FIG. 1, such that the resulting crosstalk between the two is reduced by approximately 75%.

In the pin arrangement of FIG. 5, any group of three adjacent pins along a straight line through their central axis that includes a signal pin will always include at least one ground pin. By way of example, consider pin 16N, which can form groups of three pins along a straight line in six (6) different directions (diagonal downward left and diagonal downward right having insufficient pins). Four (4) of the six directions (up, down, left and right) have one additional signal pin and one additional ground pin, while the two (2) remaining directions (diagonal upward left and diagonal upward right) have two ground pins.

The above reposition of the signal pins has several consequences that cascade to the circuit board level. In the prior art of FIG. 1, all signal pins were oriented diagonally to each other, and thus one of each signal pair was found on each side of the flexible printed circuit board. In the embodiment of the invention, the signal pairs are in horizontal and vertical formations, and can thus appear on the same side of the flexible printed circuit board. While the design reduces overall crosstalk, a tradeoff is that it is more difficult for one to conceptually identify and follow the signal paths along the flexible printed circuit board from board to board.

Figure 2:
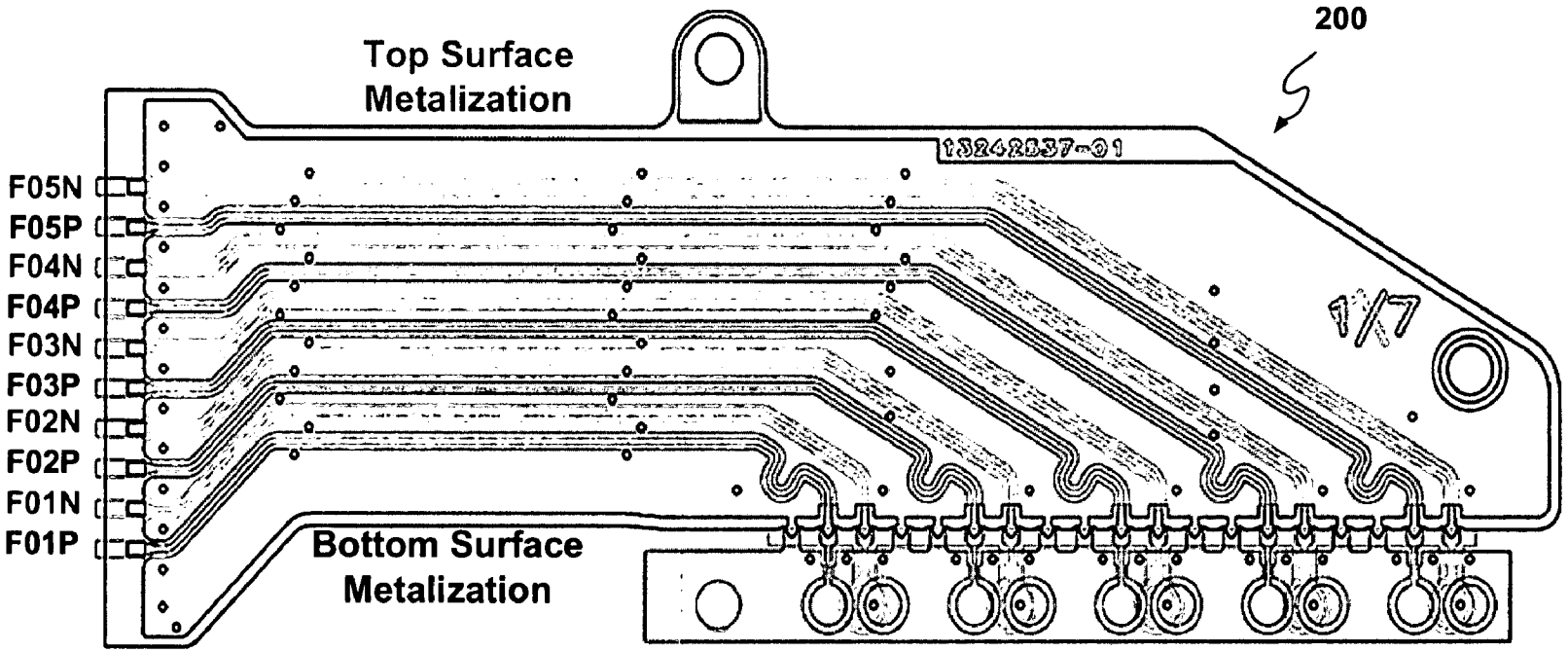
Figure 2. Prior Art
FIG. 2 illustrates the distribution of signals in a flexible printed circuit board connected to a prior art bowtie connector.
Figure 6:
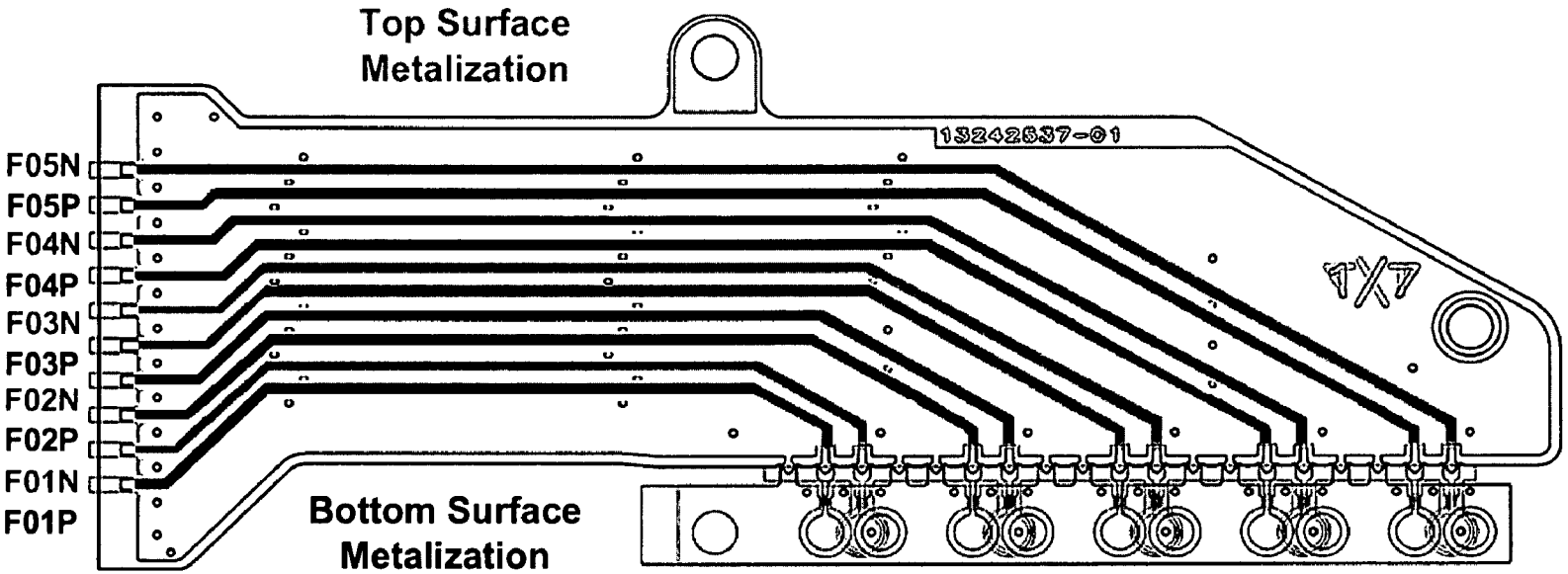
FIG. 6 illustrates the distribution of signal paths on a flex connector for a pin configuration as shown in FIG. 5.

Flexible printed circuit boards will connect with the bowtie connector in FIG. 5 in the same manner as shown in FIG. 1. However, since the signal pin paths are different, the signal path will also be different on the flexible printed circuit board. FIG. 6 shows the arrangement of signal paths for the flex connector Flex 1 shown in FIG. 5. Unlike the flexible printed circuit board of FIG. 2 in which every signal had one of its two signal pathways on a different side of the connector, the flexible printed circuit board in FIG. 5 can have the signal pathways on the same sides of the flexible printed circuit board.

It is noted that the foregoing examples have been provided merely for the purpose of explanation and are in no way to be construed as limiting of the present invention. While the present invention has been described with reference to certain embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A connector, comprising:

a plurality of parallel pins mounted in a connector;

a circuit board connected to said connector;

some of said pins being configured to communicate signals from said circuit board and others of said pins being configured to communicate corresponding signal grounds from said circuit board;

said pins being organized on said connector such that:

at least two out of every three of said pins that are configured to communicate signals do not have any neighboring aggressor pins; and at least one of the pins that are configured to communicate signals has at least one neighboring aggressor pin.

2. The connector of claim 1, wherein said pins are organized on said connector such that only one pair of said pins that is configured to communicate a common signal has at least two neighboring aggressor pins.

3. The connector of claim 1, wherein said connector is separated into quadrants in which said pins are male and two different quadrants in which said pins are female.

4. The connector of claim I, wherein said connector is a bowtie connector.

5. The connector of claim 1, further comprising at least one flexible printed circuit board connected to said pins.

6. The connector of claim 5, wherein said one flexible printed circuit board has conductive pathways on two sides thereof.

7. The connector of claim 5, wherein said signals comprise distinct signal pairs, pathways for individual signal pairs of approximately half of said signals are on common sides of said flexible printed circuit board, and pathways for individual signal pairs of a remainder of said signals are on opposite sides of said flexible printed circuit board.

8. A bowtie connector, comprising:

a plurality of parallel pins mounted in a bowtie connector;

a circuit board connected to said bowtie connector;

some of said pins being configured to communicate signals from said circuit board and others of said pins being configured to communicate corresponding signal grounds from said circuit board; and said pins being organized such that any diagonally adjacent pins aligned in a straight line through their axis will include at least one of said pins configured to communicate corresponding signal grounds and at least one of said pins configured to communicate signals.

9. The connector of claim 8, wherein said pins are organized on said bowtie connector such that only one pair of said pins that is configured to communicate a common signal has at least two neighboring aggressor pins.

10. The connector of claim 8, wherein said bowtie connector is separated into two quadrants in which said pins are male and two different quadrants in which said pins are female.

11. The connector of claim 8, further comprising at least one flexible printed circuit board connected to said pins.

12. The connector of claim 11, wherein said flexible printed circuit board has conductive pathways on two sides thereof.

13. The connector of claim 11, wherein said signals comprise distinct signal pairs, pathways for individual signal pairs of approximately half of said signals are on common sides of said flexible printed circuit board, and pathways for individual signal pairs of a remainder of said signals are on opposite sides of said flexible printed circuit board.

14. A connector, comprising:

a plurality of pins configured to carry thirty-six distinct signal pairs and thirty-six corresponding signal ground pairs;

twenty-four of said thirty-six distinct signal pairs having no neighboring aggressor pins;

eight of said thirty-six distinct signal pairs having a single neighboring aggressor pin; and four of said thirty-six distinct signal pairs having two neighboring aggressor pins.

15. The connector of claim 14, wherein said connector is separated into two quadrants in which said pins are male and two different quadrants in which said pins are female.

16. The connector of claim 14, further comprising at least one flexible printed circuit board connected to said pins.

17. The connector of claim 16, wherein said one flexible printed circuit board has conductive pathways on two sides thereof.

18. A bowtie connector, comprising:

a plurality of parallel pins mounted in a bowtie connector;

a circuit board connected to said bowtie connector;

some of said pins being configured to communicate signals from said circuit board and others of said pins being configured to communicate corresponding signal grounds from said circuit board; and said pins being organized such that any four adjacent pins aligned diagonally in a straight line through their axis that includes at least one of said pins configured to communicate signals will also include at least one of said pins configured to communicate corresponding signal grounds.

19. The connector of claim 18, wherein said pins are organized on said connector such that only one pair of said pins that is configured to communicate a common signal has at least two neighboring aggressor pins.

20. The connector of claim 18, wherein said connector is separated into two quadrants in which said pins are male and two different quadrants in which said pins are female.

21. The connector of claim 18, further comprising at least one flexible printed circuit board connected to said pins.

22. The connector of claim 21, wherein said one flexible printed circuit board has conductive pathways on two sides thereof.

23. The connector of claim 21, wherein said signals comprise distinct signal pairs, pathways for individual signal pairs of approximately half of said signals are on common sides of said flexible printed circuit board, and pathways for individual signal pairs of a remainder of said signals are on opposite sides of said flexible printed circuit board.

24. A connector, comprising:

a plurality of parallel pins mounted in a connector, said plurality of parallel pins all having the same shape;

a circuit board connected to said connector;

some of said pins being configured to communicate signals from said circuit board and others of said pins being configured to communicate corresponding signal grounds from said circuit board;

said pins being organized on said connector such that at least two out of every three of said pins that are configured to communicate signals do not have any neighboring aggressor pins.

25. The connector of claim 14, wherein said connector is a bowtie connector.

* * * * *